US006909403B2

(12) United States Patent
Wang et al.

(10) Patent No.: US 6,909,403 B2
(45) Date of Patent: Jun. 21, 2005

(54) BROAD BAND ANTENNA

(75) Inventors: Daniel Wang, Parramatta (AU); Robert Daly, Chirnside Park (AU); Steve Jaques, St. Ives (AU)

(73) Assignee: R. F. Industries Pty Ltd., North Rocks (AU)

( * ) Notice: Subject to any disclaimer, the term of this patent is extended or adjusted under 35 U.S.C. 154(b) by 28 days.

(21) Appl. No.: 10/687,335

(22) Filed: Oct. 16, 2003

(65) Prior Publication Data

US 2005/0001783 A1 Jan. 6, 2005

(30) Foreign Application Priority Data

Oct. 17, 2002 (AU) ..... 2002952142

(51) Int. Cl.[7] ..... H01Q 1/24
(52) U.S. Cl. ..... 343/702; 343/700 MS; 343/872
(58) Field of Search ..... 343/702, 700 MS, 343/872, 895, 722, 795

(56) References Cited

U.S. PATENT DOCUMENTS

| | | | | | |
|---|---|---|---|---|---|
| 4,229,743 | A | | 10/1980 | Vo et al. | 343/895 |
| 5,701,130 | A | | 12/1997 | Thill et al. | 343/895 |
| 6,069,592 | A | * | 5/2000 | Wass | 343/895 |
| 6,075,488 | A | * | 6/2000 | Hope | 343/702 |
| 6,369,777 | B1 | * | 4/2002 | Ohara et al. | 343/895 |
| 6,642,893 | B1 | * | 11/2003 | Hebron et al. | 343/702 |
| 6,642,895 | B2 | * | 11/2003 | Zurcher et al. | 343/718 |

OTHER PUBLICATIONS

Qin Li, Chi Hou Chan and Leung Tsang, "Monte Carlo Simulations of Wave Scattering from Lossy Dielectric Random Rough Surfaces Using the Physics–Based Two–Grid Method and the Canonical–Grid Method", IEEE Transactions on Antennas and Propagation, vol. 47, No. 4, Apr. 1999.

Hanyang Y. Wang and Michael J. Lancaster, "Aperture Coupled Thin–Film Superconducting Meander Antennas", IEEE Transactions on Antennas and Propagation, vol. 47, No. 5, May 1999.

Hiroaki Miyashita et al., "Electromagnetically Coupled Coaxial Dipole Array Antenna", IEEE Transactions on Antennas and Propagation, vol. 47, No. 11, Nov. 1999.

M.A. Page–Jones and M.H. Capstick, "Single Layer Patch Arrays Exploiting a Quasibalanced Feeder to Improve the Radiation Pattern", IEE Proceedings—Microwave Antennas Propagation, vol. 146, No. 6, Dec. 1999.

* cited by examiner

*Primary Examiner*—Don Wong
*Assistant Examiner*—Huedung X. Cao
(74) *Attorney, Agent, or Firm*—Baker & Daniels

(57) ABSTRACT

A collinear antenna segment is provided with a plurality of radiating elements and inter-element phasing sections arranged alternately on a singlesided elongated substrate. The segment has an operatively curved in-use configuration about a longitudinal axis running substantially along the length of the segment. In use, the inter-element phasing sections allow the radiating elements to radiate electromagnetic radiation substantially in phase over an intended range of frequencies. The segment may be arranged on a flexible substrate which can be operatively curved for insertion into a radome. Alternatively, the segment may be directly arranged on the curved inner surface of a radome.

9 Claims, 3 Drawing Sheets

BROAD BAND ANTENNA

FIELD OF THE INVENTION

The present invention relates to antenna devices, and, more particularly to collinear antennas.

BACKGROUND OF THE INVENTION

Series collinear antenna segments are well known in the field of antenna design. They have a number of advantages over other collinear antenna strategies such as a corporate feed collinear because of their ease of construction and associated affordability. They consist of a number of alternate radiating elements and inter-element phasing sections resulting in a phased array antenna.

Each radiating element is optimally fed in phase so that each of the radiating elements will radiate in unison. This enables the focussing of the antenna radiation pattern. Each individual radiating element is designed to be of a specific physical length in order to provide the most effective radiation of power for a given wavelength. Following each active radiating element is an inter-element phasing section, wherein the radiation from the antenna is suppressed until the next correct phase point on the wavefront is reached, wherein another radiating element is fed in series.

The ideal theoretical inter-element phasing section would see the suppression of ½ λ (180 degrees of phase) of the wave front, where λ is the design wavelength for the antenna. Also ideally, the physical length of the radiating element should be ½ λ. In addition, the ideal theoretical physical spacing between the two radiating elements would be ¼ λ as measured from the top of one radiating element to the bottom of the next radiating element. Clearly, there are competing design constraints here which make realisation of the theoretical ideal difficult. Furthermore, in practice, users require coverage over a range of wavelengths. When the wavelength in use changes from the design wavelength, the side lobes of the antenna radiation pattern become more pronounced. Also elevation tilt in the radiation pattern is induced when the individual radiating elements are not fed precisely in phase with each other.

There a number of approaches in the prior art which attempt to realise this theoretical ideal. The most common is the Franklin collinear array. Most such Franklin antennas are manufactured using a coaxial cable feed line, and the velocity of propagation, $v_p$, of the coaxial cable can help the designer get closer to the theoretical ideal. By making use of a reduced $v_p$ in the inter-element phasing section, the physical length associated with a ½ λ phase difference can be reduced somewhat. However, this approach is a compromise and as more radiating elements are added to the series collinear antenna segment the errors introduced become compounded.

Another approach is to use a ½ λ wire phasing coil for the inter-element phasing section. Coil based series collinear antenna segments such as this have ½ λ phase elements which are separated by the ideal physical spacing of ¼ λ. However, although these coils include both inductive and capacitive components, their capacitance is high and thus the Q factor and hence the wavelength sensitivity is high. This implies that the introduced phase difference may well be 180° at the design wavelength, but then vary significantly with wavelength in comparison with a coaxial inter-element phasing section as adopted in the Franklin approach. Therefore these designs are essentially narrowband. They are not used where extended bandwidths are required due to the performance degradation in pattern stability which results from the variation in the phase difference with wavelength. Another significant disadvantage is that the physical structure of the coils must be very tightly controlled, especially when designing for short wavelengths thus adding to the cost of manufacture. Moreover, the coils themselves must be made of a material which is sturdy enough to support itself physically.

A natural extension to this coil design approach is to replace the physical coils with one which is reproduced entirely on a circuit board. Such attempts have included a helical coil which is printed on the outside of a round former, simply reproducing the physical coil. This approach effectively simulates a physical coil but it is also expensive and has not seen acceptance. In addition this approach also fails to address the large variation in phase introduced as a function of wavelength.

Another further approach to approximate a coil is to implement a meander on a flat circuit board. This does provide a high inductance, lower capacitance inter-element phasing section due to the low capacitance of the tracks on the circuit board but consequently the matching ability of a flat meander is significantly degraded. This is because the radiating elements and the flat meander are not well de-coupled from each other and hence the definition between these two components of a series collinear antenna segment is poor, resulting in reduced bandwidth and performance. Consequently this approach is used only for smaller, lower gain antennas, where performance is not critical. Other electrical components can be added to series collinear antenna segments which use a flat meander inter-element phasing section to introduce the desired capacitance. However, this results in significantly increased costs of production.

Accordingly it is an object of the present invention to provide for series collinear antenna segments, and antennas, with improved broad band characteristics.

It is a further object of the invention to provide for series collinear antenna segments, and antennas, with improved broad band characteristics and which are convenient and low cost to manufacture when compared with prior art designs.

SUMMARY OF THE INVENTION

The present invention provides a series collinear antenna segment, including a plurality of radiating elements and inter-element phasing sections, arranged alternately on a single sided elongated substrate, wherein said segment is adapted to be operatively curved in an at use configuration about a longitudinal axis running substantially along the length of said segment, and wherein said inter-element phasing sections are operatively adapted to allow said radiating elements to radiate electromagnetic radiation substantially in phase over an intended range of frequencies.

The present invention enables a number of advantages to be realized when compared with the prior art. The present invention has improved broad band characteristics when compared to standard design series collinear antenna segments implemented in a flat configuration on a standard PCB substrate. The curving of the substrate provides for increased capacitance providing a more improved inter-element phasing section. By using a single flexible substrate, well known cost efficient manufacturing techniques can be used. There is no need to incorporate secondary elements which add to the complexity of the antenna and hence to the cost of manufacture.

Preferably, the inter-element phasing sections and radiating elements are arranged so that operatively they face substantially perpendicular to each other. This provides excellent decoupling between the radiating and passive sections of the series collinear antenna segment further improving the performance.

Preferably the inter-element phasing sections include a conductive track arranged to follow a serpentine path. This is a cost effective technique for introducing phase differences between radiating elements.

BRIEF DESCRIPTION OF THE DRAWINGS

An illustrative embodiment of the present invention will be described with reference to the accompanying drawings wherein.

DESCRIPTION OF EMBODIMENT

Figure 1:
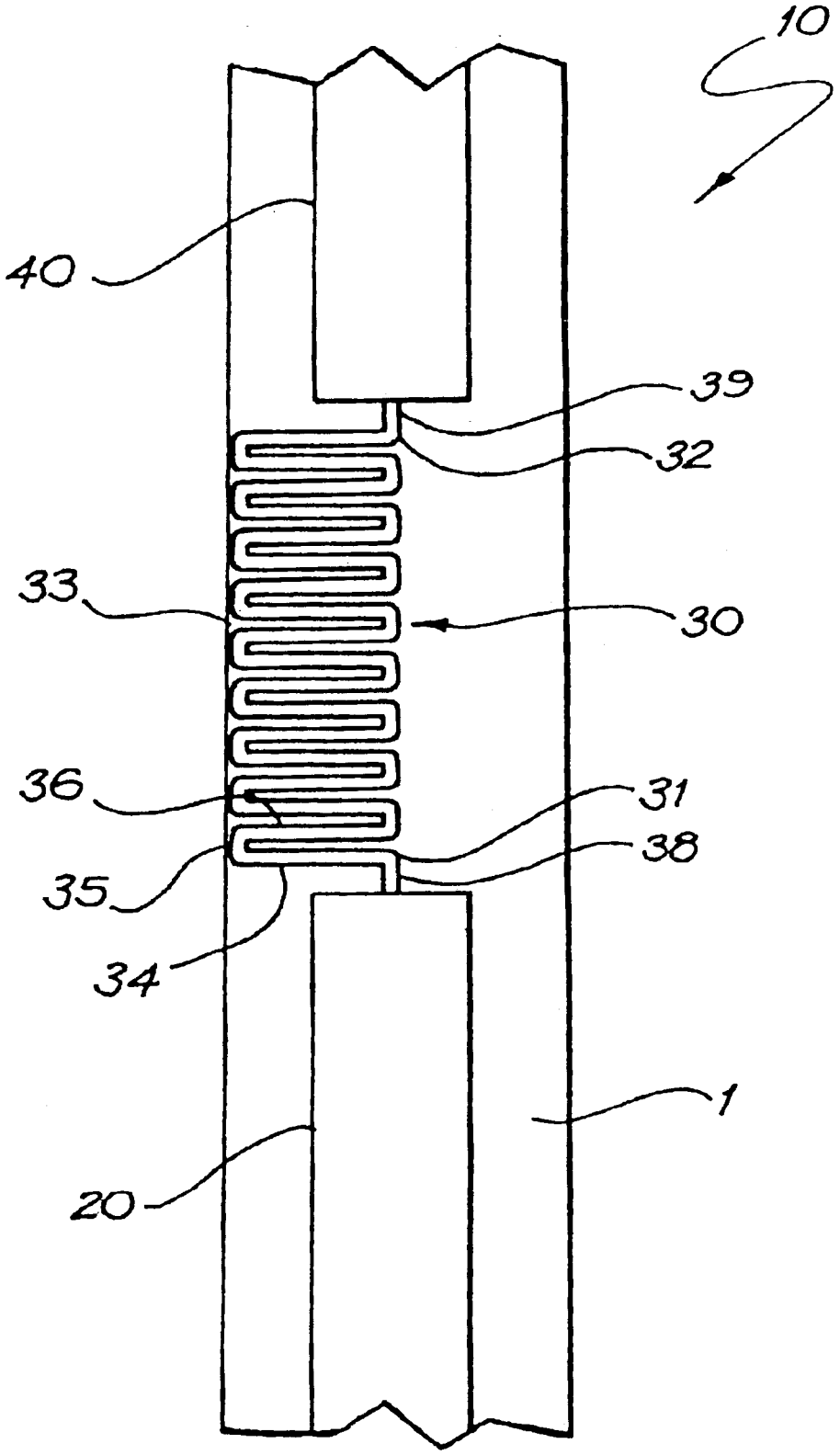
FIG. 1 is a plan view of a series collinear antenna segment in a flat configuration.

Referring now to FIG. 1 there is illustrated a series collinear antenna segment 10. The segment consists of a first radiating element 20, an inter-element phasing section 30 and a further radiating element 40 identical in dimension to the first radiating element 20. It is understood that further phasing sections and radiating elements may be added as is required. These elements consist of a conductive material such as copper disposed upon a single sided flexible continuous substrate 1. An example of a suitable substrate is standard flexible PCB material. In other embodiments the conductive material can be gold.

We will first consider the radiating elements 20 and 40. The geometry of a radiating element is primarily dependent upon the target design wavelength λ intended for the series collinear antenna segment. In this embodiment a segment suitable for use in an antenna designed for a target wavelength of 34 cm (equivalent frequency 890 MHz) and with a bandwidth of 15% is described. Such an antenna is capable of providing satisfactory performance over both CDMA and GSM wavelength bands. It will be readily apparent that the invention described here can be used for many different combinations of target wavelength and bandwidth ranges.

As indicated previously theoretical requirements indicate that the vertical length of the radiating elements 20 and 40 are approximately ½ λ. In general terms, to achieve a bandwidth target of 15%, broad theoretical design principles set out that the horizontal width of the radiating elements 20 and 40 that is required should be approximately 1/16 λ.

Inter-element phasing section 30 includes a feed entry point 31. Extending vertically between radiating element 20 and feed entry point 31 there is a lead-in track 38. Furthermore, inter-element phasing section 30 includes a feed exit point 32 from which a lead-out track 39 extends vertically from the inter-element phasing section 30 to the radiating element 40. Between the feed entry point 31 and the feed exit point 32 the conductive track follows a serpentine path starting with a first horizontal section 34 followed by a vertical section 35 and then a horizontal section 36 returning to a central position defined by a line extending between the feed entry point 31 and feed exit point 32. This path repeats a number of times until the feed exit point 32 is reached. The length of the vertical section between each horizontal track section 33 is equal to the width of the track. The track width of the inter-element phasing section 30, lead-in track 38 and lead-out track 39 are substantially equal to each other. The horizontal width of the track is comparable to the horizontal width of the radiating section. The vertical length of the inter-element phasing section (defined as the length between feed entry point 31 and feed exit point 32) is approximately ¼ λ.

It will be readily appreciated that whilst the theoretical requirements outlined herein provide a broad framework for the initial design, further detailed modelling of the series collinear antenna segment in an in-use configuration will be required to refine the exact dimensions. Computer modelling packages to perform this detailed electromagnetic simulation and optimisation are readily available. For the requirements set out herein the following physical layout was found to be optimal: track width of 2 mm for the lead-in track 38, inter-element phasing section 30 and lead-out track 39, horizontal width of 20 mm for the radiating elements, and effective horizontal width of 18 mm for the inter-element phasing section 30.

Figure 2:
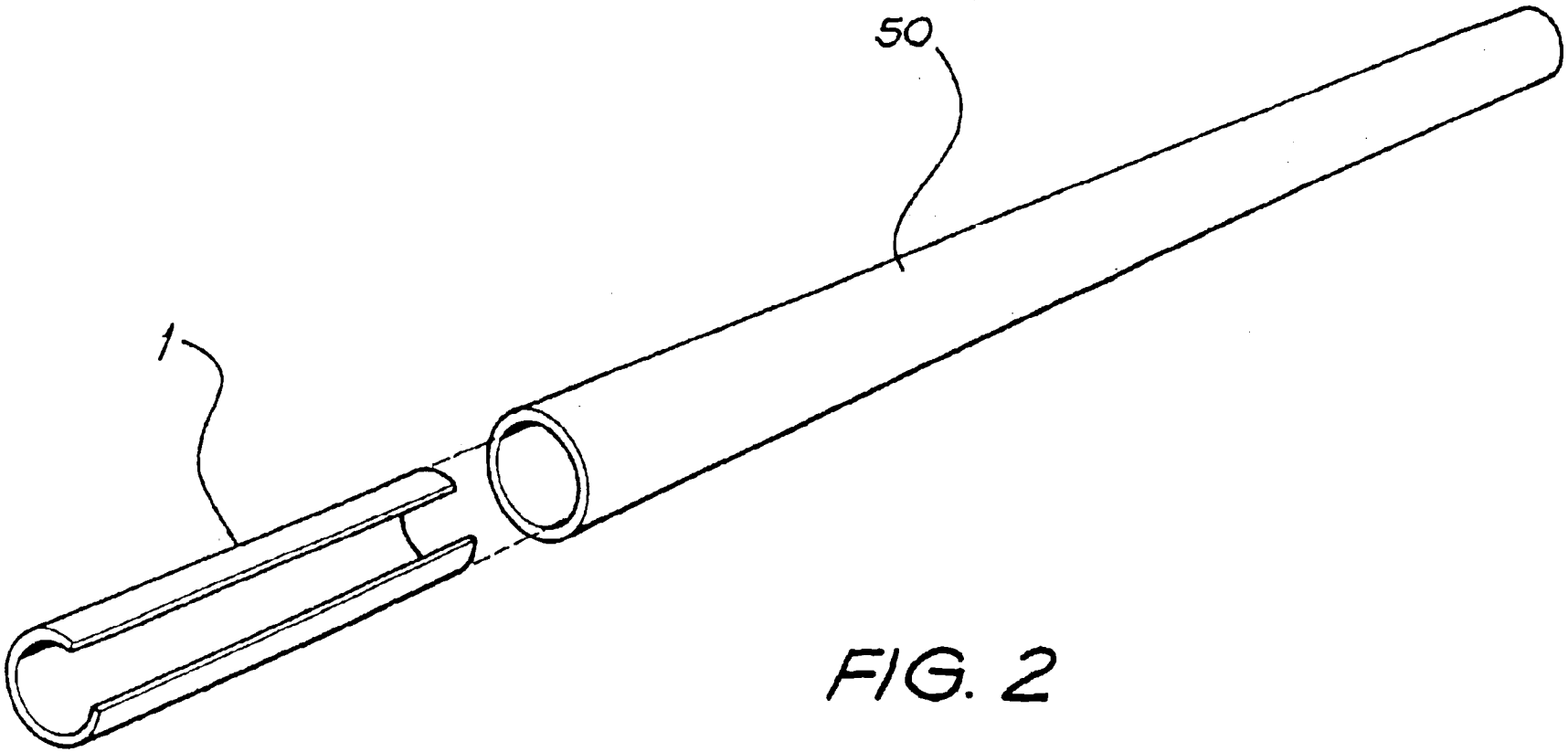
FIG. 2 is a perspective view of the series collinear antenna segment when inserted into a radome, illustrating the curved in-use configuration.

FIG. 2 illustrates the collinear antenna segment 1 as curved to an in-use configuration ready to be inserted into a radome 50 having an inside diameter of 14 mm which is typical for antennas designed for the wavelength range of interest here. As can be readily seen, the flexible substrate curves substantially so that the antenna segment 1 can conform to the cylindrical shape of the radome 50. The substrate is provided with an adhesive to secure the substrate to the inner surface of the radome 50.

This curving of the substrate introduces a number of surprising improvements to the performance of the series collinear antenna array segment 10.

Firstly, the curved inter-element phasing section 30 introduces a degree of capacitance which improves the broad band characteristics substantially over a similar design implemented in a flat configuration while still maintaining the overall capacitance to a manageable level. As a consequence, the inter-element phasing section 30 has reduced sensitivity to wavelength and hence exhibits a lower phase angle change for a given variation in the operating wavelength. This can be compared to when the substrate is in the flat configuration as depicted in FIG. 1, where there is minimal parasitic capacitance between the tracks resulting in the inter-element phasing section 30 not exhibiting enough internal parasitic capacitance to provide satisfactory matching.

Figure 3:
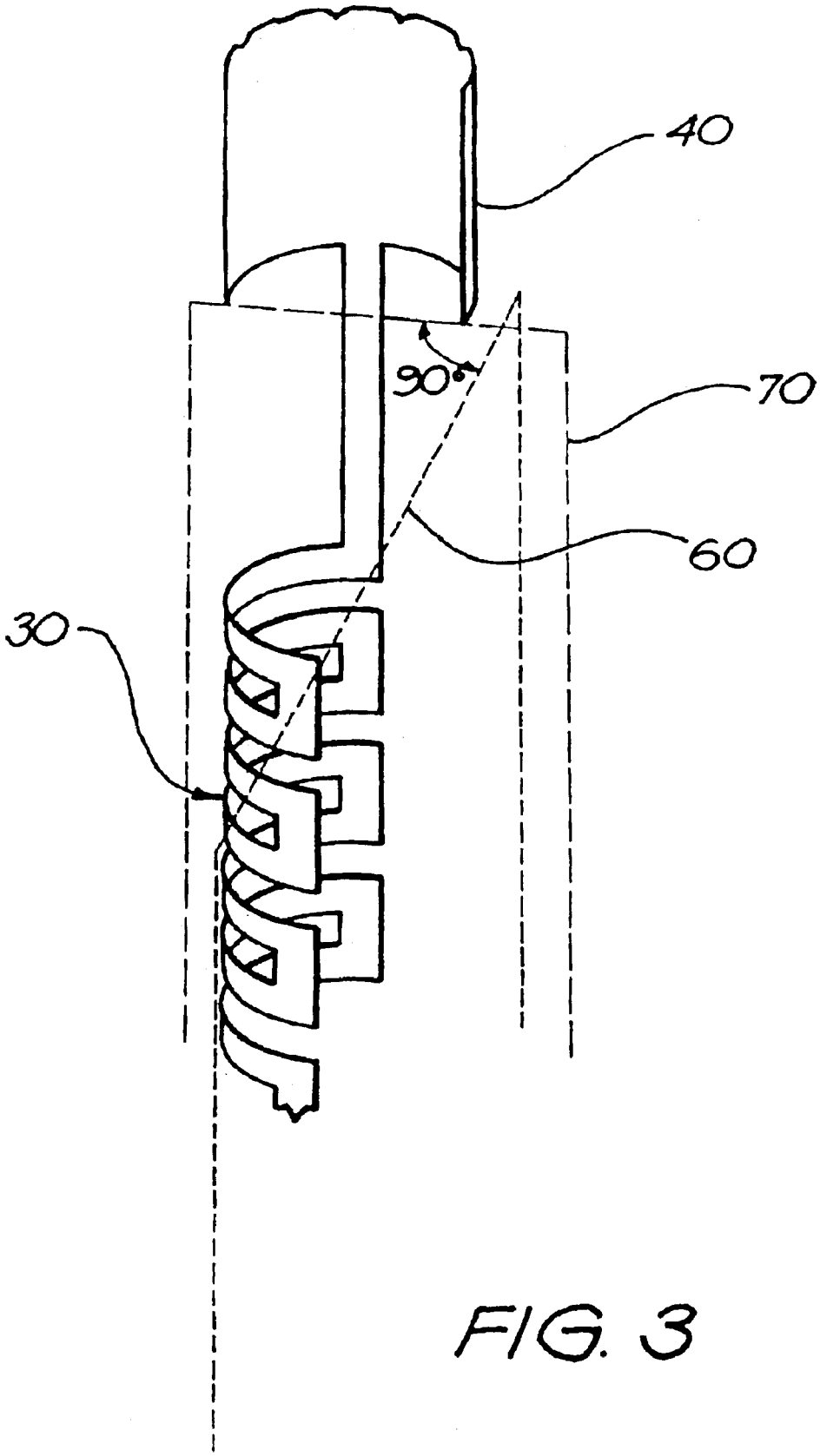
FIG. 3 is an enlarged view of the transition region between an inter-element phasing section and a radiating element when in the in-use configuration.

Secondly, the curving of the substrate also facilitates the effective electrical decoupling between the radiating and passive elements because of the layout adopted here. FIG. 3 depicts an enlarged view of the transition region between inter-element phasing section 30 and radiating element 40 when the series collinear antenna segment is in the in-use configuration. Consider a first construction plane 70 defined by the opposed edges of the radiating element when in the curved in-use configuration. Consider also a second construction plane 60 defined by the opposed edges of the inter-element phasing section. Construction planes 70 and 60 intersect each other at approximately 90 degrees, in this example. This is due to the positioning of the inter-element phasing section 30 which is offset to one side of the flexible substrate 1 from radiating elements 20 and 40. Accordingly a similar positioning relationship is also maintained between radiating element 20 and inter-element phasing section 30. This configuration ensures much improved suppression in the inter-element phasing section as currents in the inter-element phasing section do not substantially interact with those in the radiating elements.

As noted above, the curving of the substrate is predominantly defined by the cylindrical shape of the radome 50. As an alternative to using a flexible substrate for affixing to a radome, the collinear antenna segment 1 can be arranged directly onto the inner surface of the radome 50. The cylindrical shape of the radome 50 would define the curved in-use configuration of the collinear antenna segment 1.

It will be readily apparent to those skilled in the art that the invention described herein can incorporate further alternating radiating and inter-element phasing sections depending on the requirements. It will also be readily apparent to those skilled in the art that the invention can be incorporated into the design of both end-fed and centre fed collinear antennas.

Although an embodiment of apparatus of the present invention has been illustrated in the accompanying drawings and described in the foregoing detailed description, it will be understood that the invention is not limited to the embodiment disclosed, but is capable of numerous rearrangements, modifications and substitutions without departing from the scope of the invention as set forth and defined by the following claims.

The claims defining the invention are as follows:

1. A series collinear antenna segment, including a plurality of radiating elements and inter-element phasing sections arranged alternately on a single sided elongated substrate, wherein said segment is adapted to be operatively curved in an at use configuration about a longitudinal axis running substantially along the length of said segment, and wherein said inter-element phasing sections are operatively adapted to allow said radiating elements to radiate electromagnetic radiation substantially in phase over an intended range of frequencies.

2. A series collinear antenna segment as claimed in claim 1, wherein said substrate is flexible.

3. A series collinear antenna segment as claimed in claim 1, wherein said substrate includes an adhesive for affixing said substrate to a surface.

4. A series collinear antenna segment as claimed in claim 1, wherein said substrate is a radome and said segment is arranged on an inner surface of said radome.

5. A series collinear antenna segment as claimed in claim 1 wherein said inter-element phasing section is arranged offset laterally and to one side of a longitudinal axis running substantially along the centre of said substrate such that said radiating elements and said inter-element phasing sections are operatively facing substantially perpendicular to each other.

6. A series collinear antenna segment as claimed in claim 2 wherein said inter-element phasing section is arranged offset laterally and to one side of a longitudinal axis running substantially along the centre of said substrate such that the angle between a tangent to the curved radiating element at the element centre and said inter-element phasing section can be adjusted by varying the degree of curvature of the flexible substrate in order to adjust the degree of coupling between the inter-element phasing section and the radiating element from a minimum of 90 degrees to a larger value at less than 90 degrees.

7. A series collinear antenna segment as claimed in claim 1 wherein said inter-element phasing section includes a conductive track, said conductive track arranged to follow a serpentine path.

8. An end fed series collinear antenna incorporating at least one series collinear antenna segment as claimed in claim 1.

9. A centre-fed collinear antenna incorporating at least one series collinear antenna segment as claimed in claim 1.

* * * * *